US009474930B2

(12) United States Patent
Hsu

(10) Patent No.: US 9,474,930 B2
(45) Date of Patent: Oct. 25, 2016

(54) STEPPING TRAINING MACHINE

(71) Applicant: Gee Hoo Fitec Corp.

(72) Inventor: Ching-Lu Hsu, Taipei (TW)

(73) Assignee: GEE HOO FITEC CORP., New Taipei (TW)

( * ) Notice: Subject to any disclaimer, the term of this patent is extended or adjusted under 35 U.S.C. 154(b) by 38 days.

(21) Appl. No.: 14/517,829

(22) Filed: Oct. 18, 2014

(65) Prior Publication Data

US 2016/0107026 A1 Apr. 21, 2016

(51) Int. Cl.
*A63B 23/04* (2006.01)
*A63B 23/08* (2006.01)

(52) U.S. Cl.
CPC ..... *A63B 23/0476* (2013.01); *A63B 23/085* (2013.01)

(58) Field of Classification Search
CPC ..... A63B 23/04; A63B 23/0458; A63B 23/0464; A63B 23/0476; A63B 22/04; A63B 22/0046; A63B 22/06; A63B 22/0664; A63B 21/225; A63B 22/0605; A63B 2022/0038; A63B 2022/0611; A63B 21/00069; A63B 2022/0623; A63B 2022/0652; A63B 2210/00; A63B 71/0036; A63B 17/04
USPC ..... 482/52–53, 80, 57, 79
See application file for complete search history.

(56) References Cited

U.S. PATENT DOCUMENTS 3,259,385 A * 7/1966 Boren ..... A63B 22/0694 248/165
4,262,902 A * 4/1981 Dranselka ..... A63B 22/0605 482/60
4,390,177 A * 6/1983 Biran ..... A63B 21/1609 188/83
4,478,213 A * 10/1984 Redding ..... A61H 1/0214 601/26
4,776,583 A * 10/1988 Jennings ..... A63B 24/00 482/58
4,824,132 A * 4/1989 Moore ..... A61G 5/023 280/250.1
4,828,522 A * 5/1989 Santos ..... A63B 22/0605 441/129
4,838,547 A * 6/1989 Sterling ..... A63B 23/00 482/104
5,108,092 A * 4/1992 Hurst ..... A63B 22/0005 482/60
5,314,392 A * 5/1994 Hawkins ..... A63B 22/0056 482/52
5,480,365 A * 1/1996 Lundin ..... A63B 22/0056 482/53
5,514,053 A * 5/1996 Hawkins ..... A63B 21/15 482/63

(Continued)

*Primary Examiner* — Oren Ginsberg
*Assistant Examiner* — Andrew S Lo
(74) *Attorney, Agent, or Firm* — Tracy M. Helms; Lynette Wylie; Apex Juris, pllc

(57) ABSTRACT

A stepping training machine includes a case, a stepping device, an adjusting device, and a base. The stepping device connected to the case, and has two pedals for a user to step. The adjusting device has an extending member connected to the case. The extending member is provided with a holding member, and the holding member is adapted to engage an object. The base is connected to the adjusting device, and the object will press the base when it is engaged with the holding member. Therefore, the stepping training machine may be held still by the engagement of the holding member and the object to let the user step in a stable condition.

6 Claims, 6 Drawing Sheets

(56) References Cited

U.S. PATENT DOCUMENTS 5,628,709 A * 5/1997 Chen ..... A63B 22/0064 482/146
5,647,822 A * 7/1997 Avganim ..... A63B 22/0007 482/57
5,888,175 A * 3/1999 Chang ..... A63B 22/0064 482/147
6,692,410 B1 * 2/2004 Lai ..... A63B 21/015 482/52
6,709,368 B1 * 3/2004 Chue ..... A63B 21/015 482/52
6,830,539 B2 * 12/2004 Chuang ..... A63B 23/0429 482/112
7,033,306 B2 * 4/2006 Graber ..... A63B 22/0664 482/52
7,422,549 B2 * 9/2008 Matthews ..... A63B 22/0007 482/62
7,621,852 B2 * 11/2009 Bowser ..... A63B 23/1209 482/121
7,625,318 B1 * 12/2009 Heyn ..... A63B 21/4013 482/100
7,648,447 B2 * 1/2010 Andre ..... A63B 22/0694 482/60
7,695,410 B2 * 4/2010 Kim ..... A63B 21/027 482/122
7,935,027 B2 * 5/2011 Graber ..... A63B 21/015 482/51
7,993,247 B1 * 8/2011 Eschenbach ..... A63B 22/001 482/51
8,152,698 B1 * 4/2012 Chen ..... A63B 22/00 482/53
8,795,141 B2 * 8/2014 Huang ..... A47C 13/00 142/51
8,979,712 B2 * 3/2015 Lo ..... A63B 21/026 482/51
9,301,618 B2 4/2016 Leonhard
2002/0155927 A1 * 10/2002 Corbalis ..... A63B 22/0007 482/52
2005/0054492 A1 * 3/2005 Neff ..... A63B 21/008 482/57
2005/0064996 A1 * 3/2005 Chen ..... A63B 22/0056 482/53
2005/0288156 A1 * 12/2005 Liao ..... A63B 21/012 482/52
2006/0035756 A1 * 2/2006 Chen ..... A63B 22/0069 482/53
2006/0270526 A1 * 11/2006 Jyr ..... A63B 22/0056 482/53
2008/0058168 A1 * 3/2008 Lin ..... A63B 22/0664 482/52
2008/0167165 A1 * 7/2008 Liao ..... A63B 22/001 482/52
2009/0239714 A1 * 9/2009 Sellers ..... A63B 22/001 482/52
2011/0237403 A1 * 9/2011 Huber ..... A63B 22/0605 482/57
2014/0187383 A1 * 7/2014 Martin ..... A47B 83/04 482/8

* cited by examiner

STEPPING TRAINING MACHINE

BACKGROUND OF THE INVENTION

1. Technical Field

The present invention relates to a covering of a training machine, and more particularly to a stepping training machine.

2. Description of Related Art

In modern days, people have to work for a long time every day, so they don't get enough time for exercise. A new type of exercise is called "slight exercise", which is a light loaded exercise for people to take in the workplace.

For example, a stepping training machine for slight exercise may be put under a desk for a user to train his/her legs while he/she is working.

However, such stepping training machine is unstable while the user is stepping on it, it will move because of stepping. Therefore, the user has to move the machine back repeatedly, and it is very inconvenient.

BRIEF SUMMARY OF THE INVENTION

In view of the above, the primary objective of the present invention is to provide a stepping training machine, which trains user's legs in a stable condition.

In order to achieve the objective of the present invention, a stepping training machine includes a case, a stepping device, and an adjusting device. The stepping device is connected to the case, and has two pedals for a user to step. The adjusting device has an extending member connected to the case. The extending member is provided with a holding member, and the holding member is adapted to engage an object.

In an embodiment, the extending member of the adjusting device has an outer tube, an inner tube, and a pin; the outer tube is connected to the case, and has a bore; the inner tube has a plurality of bores arranged in a line; the inner tube is inserted in the outer tube, and the pin is inserted into the bore of the outer tube and any one of the bores of the inner tube to change a length of the extending member; the holding member is provided at an end of the inner tube.

In an embodiment, the stepping device includes two cranks, two shafts, two hubs, and two wheels; the cranks are pivoted on the cases for rotation; the two shafts are connected to the cranks; the hubs fit the shafts, and are connected to the pedals; the wheels are provided on bottoms of the pedals.

In an embodiment, the present invention further provides a base, and the base has two rails for the wheels running thereon.

In an embodiment, the base is detachably connected to a bottom of the outer tube.

In an embodiment, the holding member has a ring connected to the inner tube.

In an embodiment, the bore of the outer tube is a tapped hole; the pin has a head and a rod connected to the head; the rod has a thread adjacent to the head to engage the tapped hole.

In an embodiment, the object engages the holding member and presses the base when the pin is inserted into the bore of the outer tube and any one of the bores of the inner tube.

With such design, the stepping training machine may be held still by the engagement of the holding member and the object to let the user step in a stable condition.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
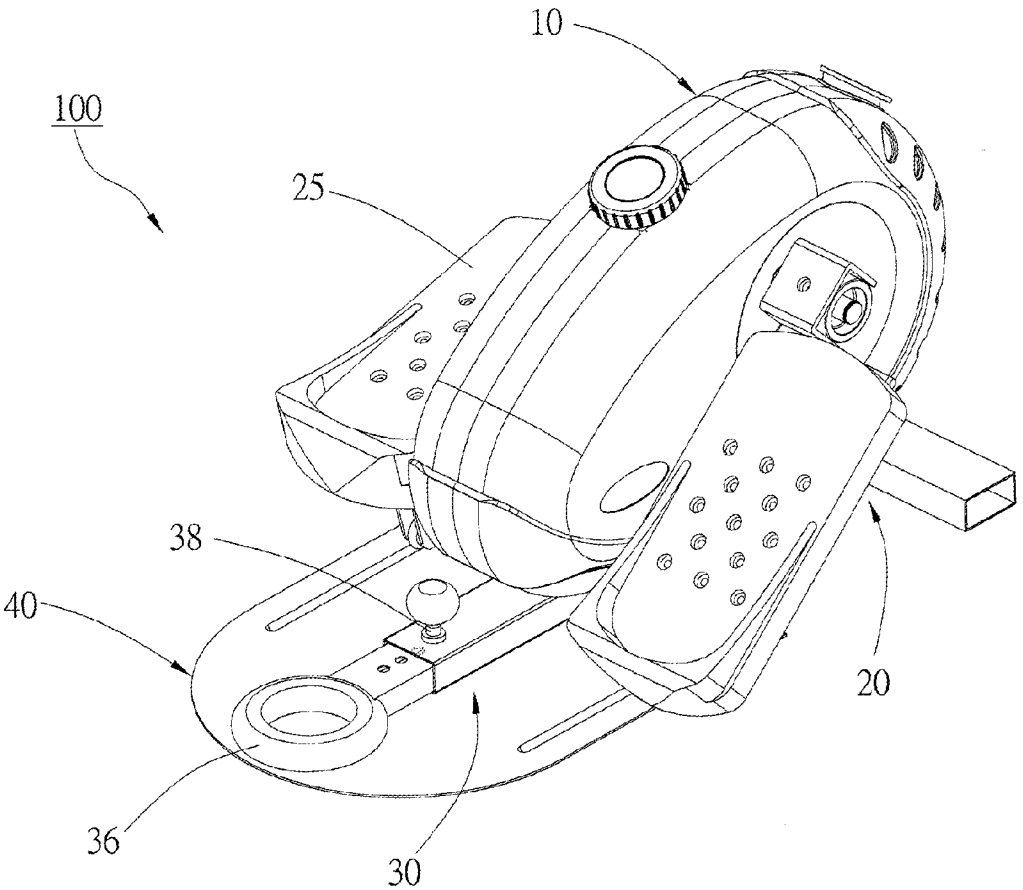
FIG. 1 is a perspective view of a preferred embodiment of the present invention.
Figure 2:
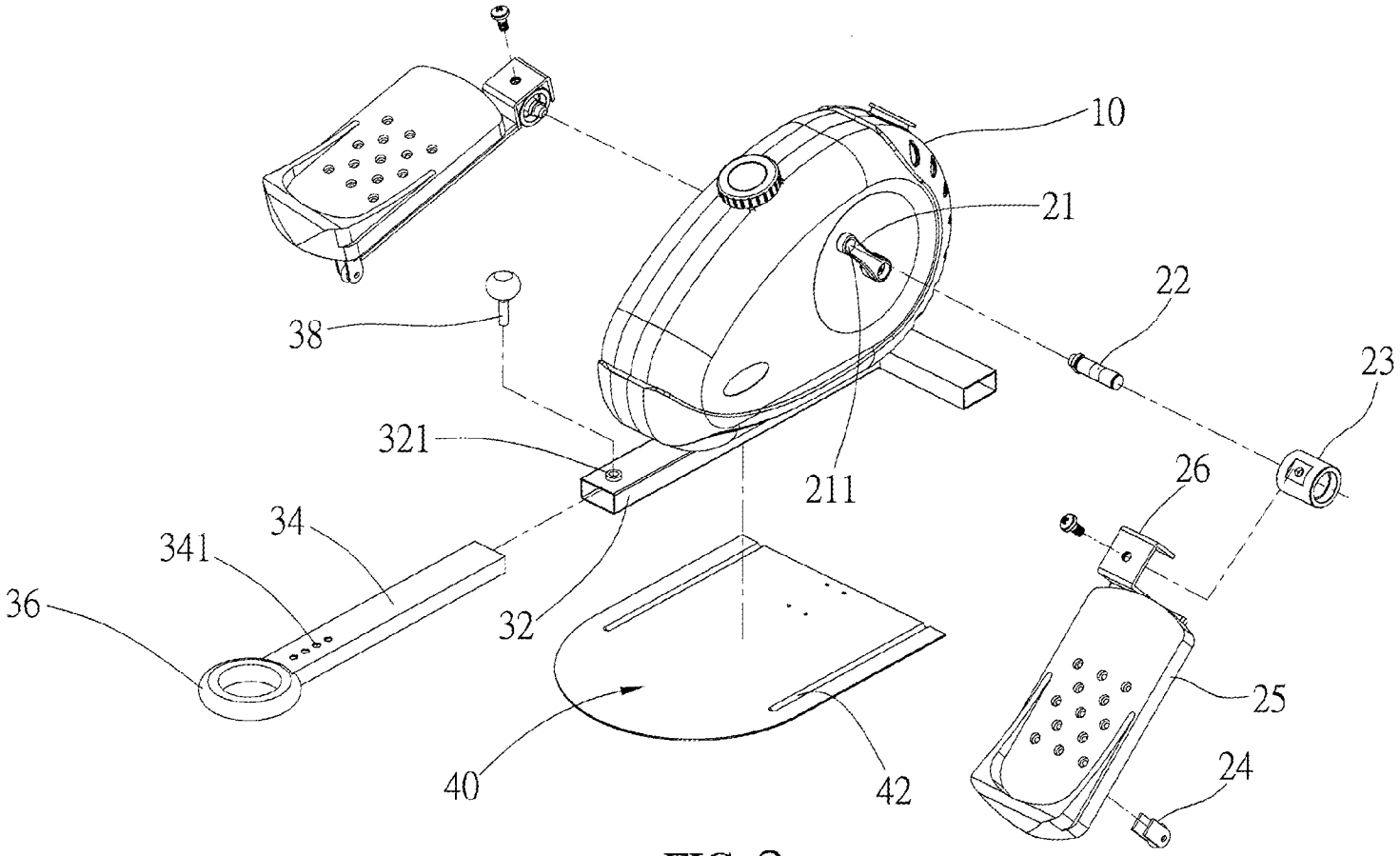
FIG. 2 is an exploded view of the preferred embodiment of the present invention.
Figure 3:
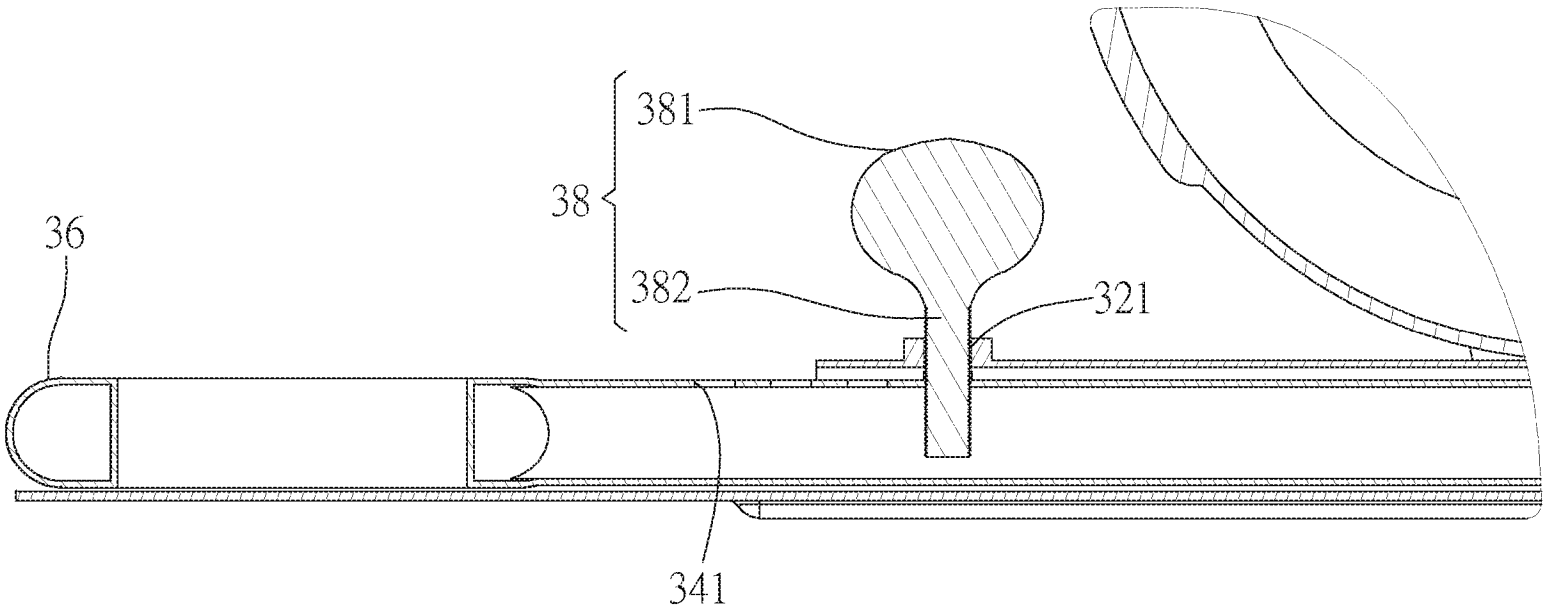
FIG. 3 is a sectional view of the preferred embodiment of the present invention, showing the pin securing the inner and the outer tubes.
Figure 4:
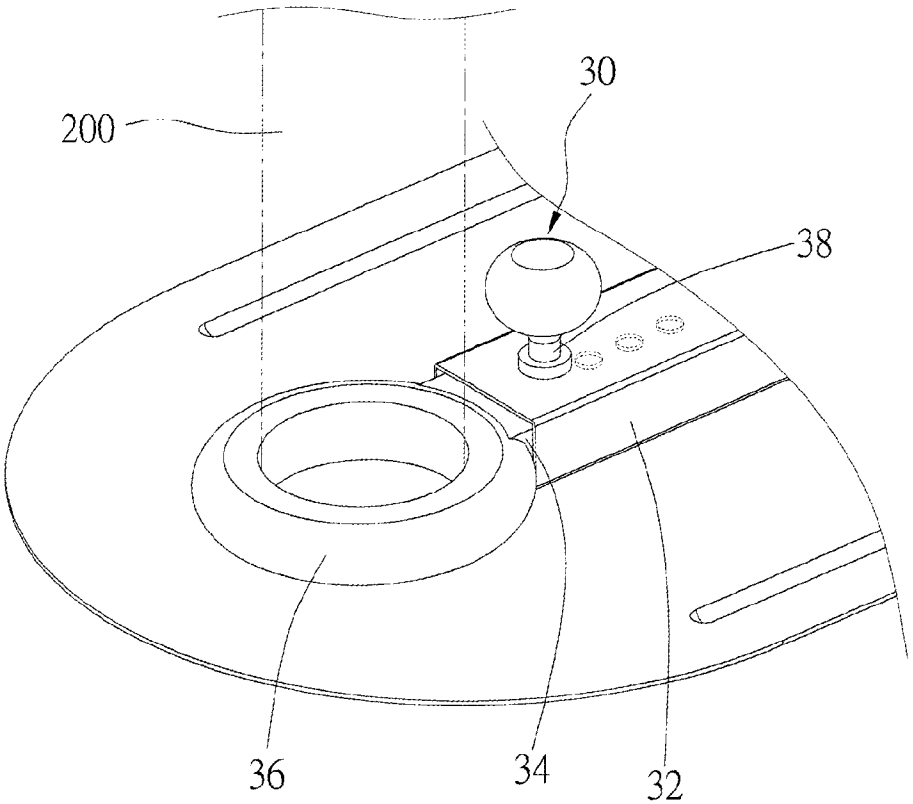
FIG. 4 is a perspective view of the preferred embodiment of the present invention, showing the pin, the inner tube, and the outer tube.

As shown in FIG. 1 to FIG. 4, a stepping training machine 100 of the preferred embodiment of the present invention includes a case 10, a stepping device 20, an adjusting device 30, and a base 40.

The case 10 is hollow, and the stepping device 20 is connected to the case 10. The stepping device 20 includes a loading module (not shown) received in the case 10, two cranks 21, two shafts 22, two hubs 23, two wheels 24, and two pedals 25. The cranks 21 are connected to opposite ends of a spindle of the loading module. Each crank 21 has a connecting end 211 at a free end to connect to the shaft 22. The hubs 23 fit the shafts 22 with bearings (not shown) for free rotation. Each pedal 25 is provided with a holder 26 at a front end thereof, and the holder 26 is connected to the hub 23. Therefore, user may stand on the pedals 25 and step to turn the cranks 21. The wheels 24 are connected to bottoms of the pedals 25 for free rotation.

The adjusting device 30 includes an extending member and a pin 38. The extending member includes an outer tube 32 and an inner tube 34. The outer tube 32 is connected to a bottom of the case 10, and has a bore 321 adjacent to an end thereof. The inner tube 34 is provided with several bores 341 arranged in a line. The inner tube 34 is inserted into the outer tube 32, and the pin 38 is inserted into both the bores 321, 341 to fix the inner and the outer tubes 34, 32. By inserting the pin 38 into different bore 341 of the inner tube 34 it could change a length of the extending member. It is noted that a transverse tube is connected to an end of the outer tube 32. A holding member, which is a ring 36, is connected to an end of the inner tube 34. The ring 36 is designed to engage an object 200 (like a leg of a desk or a chair) to hold the stepping training machine 100 at a fixed position.

In the present embodiment, the bore 321 is a tapped hole. The pin 38 has a head 381 and a rod 382 connected to the head 381, and the rod 382 has a thread adjacent to the head 381. When the pin 38 is inserted into both the bores 321, 341, it is turned to mesh the thread of the pin 38 with the tapped bore 321 that could secure the pin 38. In an embodiment, when the pin 38 is inserted into the farthest bore 341 of the inner tube 34, i.e. the extending member is adjusted to have the longest length, the ring 36 still is on the base 40. In other words, the object 200 always presses the base 40 while it is inserted into the ring 36.

Figure 5:
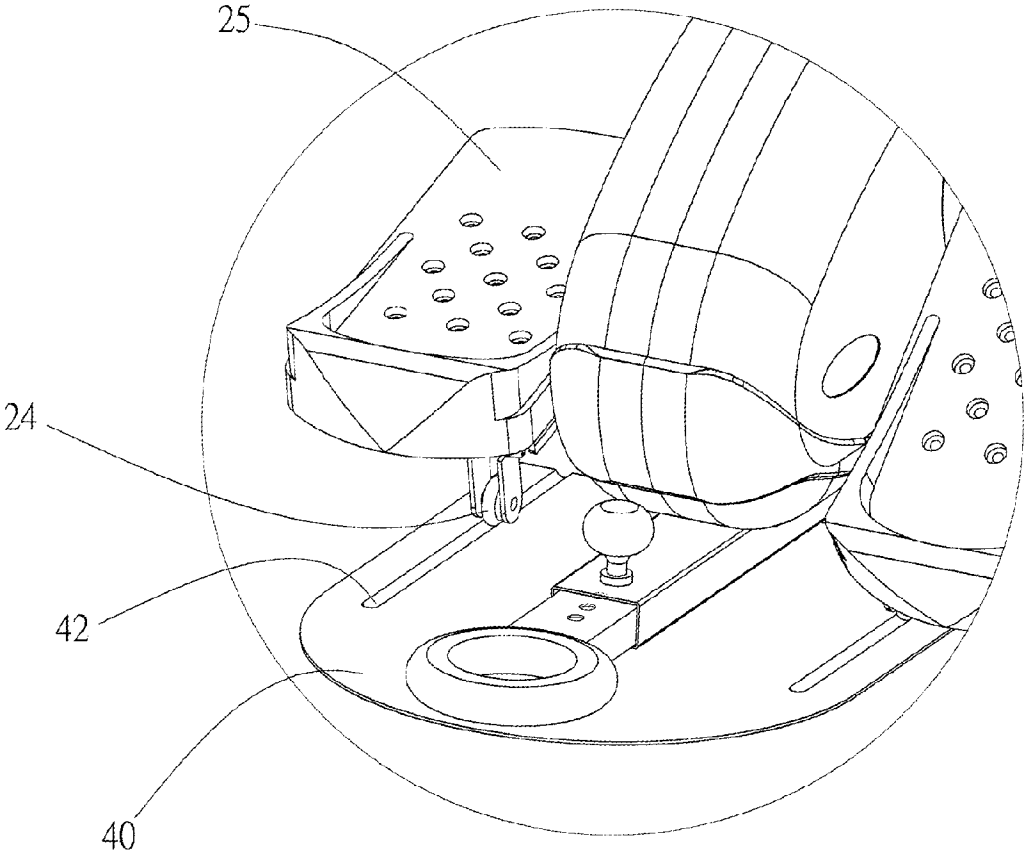
FIG. 5 is a perspective view of the preferred embodiment of the present invention, showing the wheels of the pedal on the rails.
Figure 6:
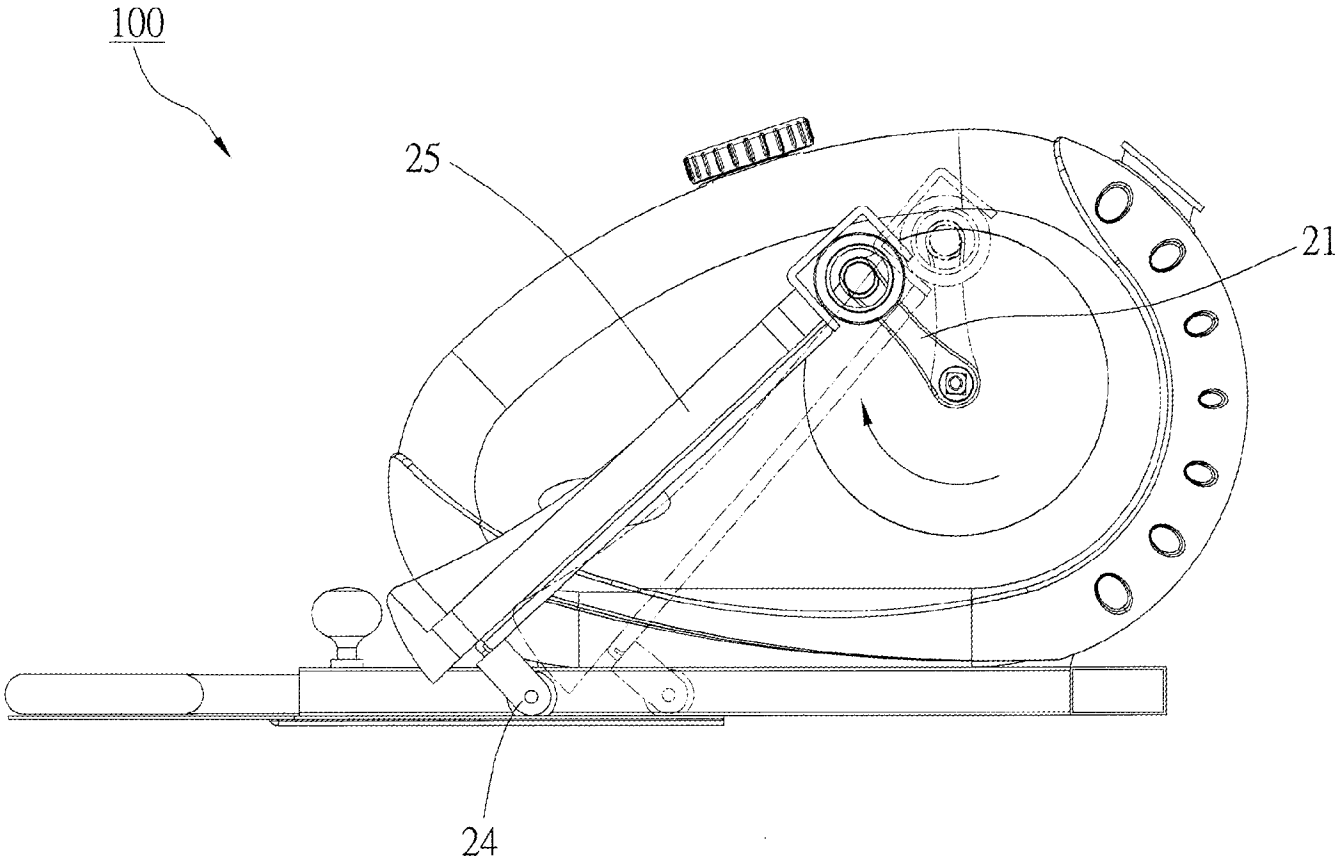
FIG. 6 is a right view of the preferred embodiment of the present invention, showing the movement of the pedal.

As shown in FIG. 5 and FIG. 6, the base 40 is a board secured to the outer tube 32 and the transverse tube by bolts (not shown). The base 40 is provided with two parallel rails 42 on a top thereof. The rails 42 are two slots on the base 40, and the wheels 24 engage the rails 42 for moving along the rails 42.

User may put the stepping training machine 100 of the present invention by a chair, and put a leg of the chair in the ring 36 to hold the stepping training machine 100. And then the user could sit on the chair, and put his/her feet on the pedals 25 and step for taking the slight exercise.

In conclusion, the stepping training machine 100 of the present invention has the following advantages and functions:

1. The base 40 may be separated from the rest elements (including the case 10 and the stepping device 20). It may reduce the size for storage and transportation.

2. By engaging the ring 36 with the object 200, it may keep a constant distance between the stepping training machine 100 and the user to facilitate the exercise.

3. When the object 200 is inserted into the ring 36, the object 200 will presses the base 40 as well. It may hold the stepping training machine 100 still when the user is stepping on the stepping training machine 100.

4. It may change the length of the extending member, which means that a distance between the pedals 25 and the user is adjustable to fit the users with different body sizes.

It must be pointed out that the embodiments described above are only some preferred embodiments of the present invention. All equivalent structures which employ the concepts disclosed in this specification and the appended claims should fall within the scope of the present invention.

What is claimed is:

1. A stepping training machine, comprising:

a case;

a stepping device connected to the case, wherein the stepping device has two pedals for a user to step;

an adjusting device having an extending member connected to the case, wherein the extending member is provided with a holding member, and the holding member is adapted to engage an object; and a base comprising a board, which has a bottom surface and a top surface opposite to the bottom surface, wherein the bottom surface is adapted to touch a ground;

wherein the extending member of the adjusting device has an outer tube, an inner tube, and a pin;

the outer tube is connected to the case, and has a bore;

the inner tube has a plurality of bores arranged in a line;

the inner tube is inserted in the outer tube, and the pin is inserted into the bore of the outer tube and any one of the bores of the inner tube to change a length of the extending member;

the holding member is provided at an end of the inner tube;

the top surface of the board contacts with a bottom surface of the outer tube;

and the holding member neighbors the top surface of the base when the pin is inserted into the bore of the outer tube and one of the bores of the inner tube.

2. The stepping training machine of claim 1, wherein the stepping device includes two cranks, two shafts, two hubs, and two wheels; the cranks are pivoted on the case for rotation; the two shafts are connected to the cranks; the hubs fit the shafts, and are connected to the pedals; the wheels are provided on bottoms of the pedals.

3. The stepping training machine of claim 2, wherein the base has two rails for the wheels running thereon.

4. The stepping training machine of claim 3, wherein the base is detachably connected to the bottom surface of the outer tube.

5. The stepping training machine of claim 1, wherein the holding member has a ring connected to the inner tube.

6. The stepping training machine of claim 1, wherein the bore of the outer tube is a tapped hole; the pin has a head and a rod connected to the head; the rod has a thread adjacent to the head to engage the tapped hole.

* * * * *